US008652714B2

(12) United States Patent
Hamaguchi et al.

(10) Patent No.: US 8,652,714 B2
(45) Date of Patent: Feb. 18, 2014

(54) ELECTROPHOTOGRAPHIC PHOTOCONDUCTOR, PROCESS CARTRIDGE INCLUDING THE SAME, AND IMAGE FORMING APPARATUS INCLUDING THE SAME

(75) Inventors: Shinichi Hamaguchi, Tokyo (JP); Tomoo Sakimura, Tokyo (JP); Mayuko Matsusaki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/595,315

(22) Filed: Aug. 27, 2012

(65) Prior Publication Data

US 2013/0052575 A1 Feb. 28, 2013

(30) Foreign Application Priority Data

Aug. 31, 2011 (JP) ..... 2011-188849

(51) Int. Cl.
*G03G 15/04* (2006.01)

(52) U.S. Cl.
USPC ..... 430/60; 430/69

(58) Field of Classification Search
USPC ..... 430/60, 69, 56, 59.5
See application file for complete search history.

(56) References Cited

U.S. PATENT DOCUMENTS

| | | | | |
|---|---|---|---|---|
| 2004/0259009 | A1* | 12/2004 | Itami et al. | 430/60 |
| 2004/0265715 | A1* | 12/2004 | Itami et al. | 430/58.05 |
| 2005/0037274 | A1* | 2/2005 | Shida et al. | 430/60 |
| 2007/0059620 | A1* | 3/2007 | Tong et al. | 430/60 |

FOREIGN PATENT DOCUMENTS

| | | |
|---|---|---|
| JP | 58-189061 | 11/1983 |
| JP | 2002-333732 | 11/2002 |
| JP | 2005-037480 | 2/2005 |
| JP | 2005-037583 | 2/2005 |
| JP | 2010-244000 | 10/2010 |
| JP | 2011-076028 | 4/2011 |

OTHER PUBLICATIONS

Japanese and full translation of Notice of Reasons for Rejection for JP 2011-188849, dispatch date: Oct. 15, 2013 (total 7 pages).

* cited by examiner

*Primary Examiner* — Stewart Fraser
(74) *Attorney, Agent, or Firm* — Lucas & Mercanti, LLP

(57) ABSTRACT

The present invention provides an electrophotographic photoconductor including an intermediate layer having sufficient electron transportability and blocking property and capable of suppressing image defects such as fogging and dots. The electrophotographic photoconductor according to the present invention includes a conductive support, a photosensitive layer disposed on the conductive support, and an intermediate layer disposed between the conductive support and the photosensitive layer, wherein the intermediate layer comprises metal oxide particles and a binder resin. The metal oxide particles are surface-treated with an alkoxysilane oligomer represented by the following Formula (1):

$$Si_nO_{n-1}(OR_1)_m(OR_2)_l \qquad \text{Formula (1)}$$

wherein $R_1$ and $R_2$ each individually represents a $C_{1-4}$ alkyl group; n represents an integer of 2 to 20; and m and l each individually represents an integer of 0 or more and satisfies an equation of m+l=2n+2.

7 Claims, 2 Drawing Sheets

ELECTROPHOTOGRAPHIC PHOTOCONDUCTOR, PROCESS CARTRIDGE INCLUDING THE SAME, AND IMAGE FORMING APPARATUS INCLUDING THE SAME

CROSS REFERENCE TO RELATED APPLICATIONS

This application is entitled and claims the benefit of Japanese Patent Application No. 2011-188849 filed on Aug. 31, 2011 the disclosure of which including the specification, drawings and abstract is incorporated herein by reference in its entirety.

TECHNICAL FIELD

The present invention relates to an electrophotographic photoconductor, a process cartridge including the electrophotographic photoconductor, and an image forming apparatus including the electrophotographic photoconductor.

BACKGROUND ART

Electrophotographic photoconductors used in copiers and printers are usually organic photoconductors that include a photosensitive layer containing an organic photoconductive material as a principal component. Such organic photoconductors are classified into two types: those having a single-layered photosensitive layer containing a charge generation material and a charge transport material; and those having laminated photosensitive layers in which a charge generation layer containing a charge generation material and a charge transport layer containing a charge transport material are laminated. Among these, the organic photoconductors having the laminated photosensitive layers, and particularly the negative charge type laminated electrophotographic photoconductors having the surface of the photoconductor to be negatively charged have been widely put to practical use because of their good electrophotographic properties, durability and high freedom of design.

The negative charge type laminated electrophotographic photoconductor usually includes a conductive support, an intermediate layer, a charge generation layer, and a charge transport layer, which are laminated in this order. When the negative charge type laminated electrophotographic photoconductor is light-exposed, it generates charges in the charge generation layer. Among the charges, the negative charges (electrons) migrate through the intermediate layer toward the conductive support, and the holes migrate through the charge transport layer toward the surface of the photoconductor and negate the negative charges on the surface of the photoconductor to form an electrostatic latent image. For this reason, the intermediate layer needs to: 1) quickly allow the electrons generated in the charge generation layer to migrate to the conductive support side (i.e., electron transportability), and 2) suppress injection of holes from the conductive support to the photosensitive layer (i.e., blocking property).

The intermediate layer usually contains metal oxide particles and a binder resin in which the metal oxide particles are dispersed. In order to improve the blocking property of the intermediate layer, increase in dispersibility of the metal oxide particles by surface treatment of the metal oxide particles has been studied. A variety of methods for surface treatment have been proposed: for instance, it is proposed to subject metal oxide particles contained in the intermediate layer to a surface treatment with anhydrous silicon dioxide (for example, PTL 1).

CITATION LIST

Patent Literature

PTL 1: Japanese Patent Application Laid-Open No. 2010-244000

SUMMARY OF INVENTION

Technical Problem

However, the surface-treated metal oxide particles described in PTL 1 do not have sufficient dispersibility in a coating solution for intermediate layer, and thus the blocking property of the obtained intermediate layer is insufficient. Therefore, particularly in an electrophotographic photoconductor having a highly sensitive photosensitive layer, holes are likely to be injected from the conductive support to the photosensitive layer, and carriers generated by thermal excitation are likely to leak. These may partially reduce the surface potential of the photoconductor, causing problems of image defects such as fogging and dots.

The present invention has been made in light of the aforementioned circumstances, and an object of the present invention is to provide an electrophotographic photoconductor that includes an intermediate layer having sufficient electron transportability and blocking property, and is capable of reducing image defects such as dots and fogging.

Solution to Problem

To achieve at least one of the above mentioned objects, an electrophotographic photoconductor reflecting one aspect of the present invention are as follows:

[1] An electrophotographic photoconductor including a conductive support, a photosensitive layer disposed on the conductive support, and an intermediate layer disposed between the conductive support and the photosensitive layer, wherein the intermediate layer includes metal oxide particles and a binder resin, the metal oxide particles being surface-treated with an alkoxysilane oligomer represented by the following Formula (1):

$$Si_nO_{n-1}(OR_1)_m(OR_2)_l \qquad \text{Formula (1)}$$

wherein $R_1$ and $R_2$ each individually represents a $C_{1-4}$ alkyl group;

n represents an integer of 2 to 20;

and m and l each individually represents an integer of 0 or more and satisfies an equation of m+1=2n+2.

[2] The electrophotographic photoconductor according to [1], wherein the metal oxide particles are titanium oxide particles surface-treated with the alkoxysilane oligomer represented by Formula (1).

[3] The electrophotographic photoconductor according to [1] or [2], wherein the metal oxide particles are further surface-treated with a reactive silicone oil or alkoxysilane.

[4] The electrophotographic photoconductor according to any one of [1] to [3], wherein a number average primary particle size of the metal oxide particles is 10 nm to 50 nm.

[5] The electrophotographic photoconductor according to any one of [1] to [4], wherein the photosensitive layer includes a mixture of a titanylphthalocyanine pigment with an adduct of 2,3-butanediol and titanyl phthalocyanine, and wherein a ratio of an absorbance at a wavelength of 780 nm (Abs780) to an absorbance at a wavelength of 700 nm (Abs700) (Abs780/Abs700) is 0.8 to 1.1, the absorbance (Abs780) and the absorbance (Abs700) being obtained by conversion from a relative reflectance spectrum of the photosensitive layer.

[6] A process cartridge detachably mountable on an image forming apparatus, the process cartridge including: the electrophotographic photoconductor according to any one of [1] to [5], and at least one unit selected from the group consisting of a charging unit for charging a surface of the electrophotographic photoconductor, a developing unit for feeding a toner to an electrostatic latent image formed on the surface of the electrophotographic photoconductor, a transferring unit for transferring the toner fed to the surface of the electrophotographic photoconductor onto a recording medium, a charge eliminating unit for eliminating charge on the surface of the electrophotographic photoconductor after toner transfer, and a cleaning unit for removing a residual toner from the surface of the electrophotographic photoconductor, wherein the electrophotographic photoconductor and the at least one unit are integrally configured.

[7] An image forming apparatus including: the electrophotographic photoconductor according to any one of [1] to [5], a charging unit for charging a surface of the electrophotographic photoconductor, an light exposing unit for light-exposing the surface of the electrophotographic photoconductor, a developing unit for feeding a toner to an electrostatic latent image formed on the surface of the electrophotographic photoconductor, a transferring unit for transferring the toner fed to the surface of the electrophotographic photoconductor onto a recording medium, a charge eliminating unit for eliminating charge on the surface of the electrophotographic photoconductor after toner transfer, and a cleaning unit for removing a residual toner from the surface of the electrophotographic photoconductor.

Advantageous Effects of Invention

An electrophotographic photoconductor according to the present invention includes an intermediate layer having sufficient electron transportability and blocking property. Hence, in image formation by the use of the electrophotographic photoconductor of the present invention, image defects such as fogging and dots can be suppressed.

DESCRIPTION OF EMBODIMENTS

1. Electrophotographic Photoconductor

Figure 1:
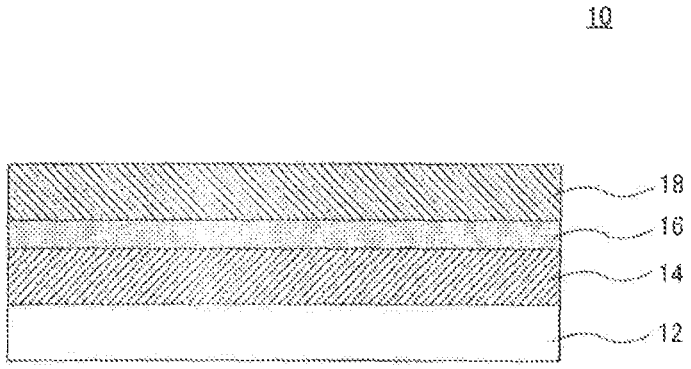
FIG. 1 illustrates an embodiment of an electrophotographic photoconductor according to the present invention.

An electrophotographic photoconductor (hereinafter may also referred to as "photoconductor" simply) is a negative charge type laminated electrophotographic photoconductor in which at least an intermediate layer and photosensitive layer are laminated on a conductive support, and when necessary, an over coat layer is further laminated. Specific examples of layer configuration in the electrophotographic photoconductor can be exemplified below:

1) a layer configuration in which an intermediate layer, a charge generation layer and a charge transport layer as a photosensitive layer, and when necessary, an over coat layer are sequentially laminated on a conductive support.

2) a layer configuration in which an intermediate layer, a single layer containing a charge transport material and a charge generation material as a photosensitive layer, and when necessary, an over coat layer are sequentially laminated on a conductive support. Hereinafter, each individual layer composing a photoconductor according to the present invention will be described based on the layer configuration in 1) above.

Conductive Support

The conductive support is a cylindrical or sheet-like conductive support. The cylindrical conductive support is adapted to rotate to continuously form an image. In order to form an image with high precision, preferably, the straightness of the cylindrical conductive support is 0.1 mm or less, and the runout thereof is 0.1 mm or less.

The conductive support can be a metallic drum made of aluminum, nickel, and the like; a plastic drum having a metal such as aluminum, tin oxide, and indium oxide deposited thereon; and a paper or plastic drum coated with a conductive compound. The resistivity of the surface of the conductive support wider normal temperature is preferably $10^3$ mΩ or less.

In order to suppress interference fringe (moire) generated by exposure, a treatment for plugging pores in the surface of the conductive support may be carried out. Examples of such pore plugging treatment include anodic oxidation of aluminum. Usually, the anodic oxidation treatment of aluminum can be performed in an acidic bath of chromic acid, sulfuric acid, oxalic acid, phosphoric acid, boric acid, sulfamic acid or the like. Preferably, the anodic oxidation treatment is performed in a sulfuric acid bath. The anodic oxidation treatment of aluminum in the sulfuric acid bath is preferably performed under the following condition: sulfuric acid concentration=100 g/L to 200 g/L, aluminum ions concentration=1 g/L to 10 g/L, solution temperature=20° C., and voltage to be applied=approximately 20 V. The average film thickness of the anodic oxide coating on aluminum is usually preferably 20 μm or less, and more preferably 10 μm or less.

Intermediate Layer

The intermediate layer has a function to transport electrons generated in the photosensitive layer to the conductive support side (the electron transport function) and a function to prevent holes from being injected from the conductive support to the photosensitive layer (blocking function). Such an intermediate layer contains metal oxide particles surface-treated with an alkoxysilane oligomer represented by Formula (1), and a binder resin in which the metal oxide particles are dispersed. Hereinafter, "metal oxide particles surface-treated with air alkoxysilane oligomer represented by Formula (1)" is referred to as "metal oxide particles" simply, and metal oxide particles before being surface-treated with an alkoxysilane oligomer represented by Formula (1) is referred to as "untreated metal oxide particles".

The untreated metal oxide particles comprises N-type semiconductive metal oxide; specifically, a metal oxide having electron transportability but no hole transportability. Examples of such a metal oxide include titanium oxide, zinc oxide, aluminum oxide, aluminum hydroxide, and tin oxides. Among these, preferable are titanium oxide and zinc oxide, and more preferable is titanium oxide in order to increase conductivity and dispersibility.

The crystal form of titanium oxide as the untreated metal oxide particles may be any of anatase, rutile forms, etc. In order to increase the dispersibility, rutile form is preferred, and in order to increase the electron transportability, anatase form is preferred. The crystal form of titanium oxide may be a mixture of those of two or more crystal forms.

The shape of the untreated metal oxide particles may be any of a branched shape, a need-like shape, and a granular shape; however, in order to increase the dispersibility of the metal oxide particles in the intermediate layer, preferred is granular shape.

The number average primary particle size of the metal oxide particles is preferably 10 nm to 400 nm, more preferably 10 nm to 200 nm, still more preferably 10 nm to 50 nm, and still yet more preferably 10 nm to 40 nm. If the number average primary particle size of the metal oxide particles is less than 10 nm, the effect of suppressing moire by the intermediate layer is reduced. On the other hand, if the number average primary particle size of the metal oxide particles is more than 400 nm, the metal oxide particles easily sediment in a coating solution for intermediate layer. Namely, the dispersibility of the metal oxide particles is reduced, and therefore, image defects such as dots are easily produced.

The number average primary particle size of the metal oxide particles can be determined as follows. Specifically, a transmission electron microscope (TEM) image of the metal oxide particles is observed at a magnification of ×10,000, and 100 particles are selected at random as primary particles. The average size of each of these 100 primary particles in the Feret's direction is measured by image analysis. Then, the average value of the obtained 100 values can be determined as the "average primary particle size."

The metal oxide particles are surface treated with an alkoxysilane oligomer represented by Formula (1) as described above.

$$Si_nO_{n-1}(OR_1)_m(OR_2)_l \qquad \text{Formula (1)}$$

In Formula (1), $R_1$ and $R_2$ each individually represent a $C_{1-4}$ alkyl group. Examples of the $C_{1-4}$ alkyl group include methyl group, ethyl group, propyl group, isopropyl group, and butyl group. Preferred is methyl group or ethyl group. $R_1$ and $R_2$ may be identical or different. A plurality of $R_1$s may be identical or different; and a plurality of $R_2$s may be identical or different.

In Formula (1), n represents an integer of 2 to 20, preferred are 4 to 15, and more preferred are 4 to 7. In Formula (1), m and l each individually represents an integer of 0 or more, and satisfies the equation, m=1=2n+2.

The alkoxysilane oligomer represented by Formula (1) may be a mixture of two or more alkoxysilane oligomers, and in that case, the average polymerization degree is preferably in the range of 2 to 20, and more preferably in the range of 3 to 15. Also, $R_1$ or $R_2$ may be a combination of different oligomers. Further, as long as the average polymerization degree is in the range of n described above, the alkoxysilane oligomer represented by Formula (1) may contain an alkoxysilane monomer in which n is 1.

Preferred examples of the alkoxysilane oligomer represented by Formula (1) include SILICATE 40 (ethoxysilane oligomer having an average polymerization degree of 5, produced by Tama Chemicals Co., Ltd.), M SILICATE 51 (methoxysilane oligomer having an average polymerization degree of 4, produced by Tama Chemicals Co., Ltd.), ETHYL SILICATE 48 (ethoxysilane oligomer having an average polymerization degree of 10, produced by Colcoat Co., Ltd.), and methoxyethoxysilane oligomer (average polymerization degree: 4.5).

The mechanism by which the metal oxide particles surface-treated with the alkoxysilane oligomer represented by Formula (1) exert excellent properties is not necessarily clear; however, the inventors deduce as follows:

Namely, the alkoxysilane oligomer represented by Formula (1) is not excessively reactive as compared to alkoxysilane monomers, and therefore may undergo moderate reactions with untreated metal oxide particles. For this reason, it is presumed that the alkoxysilane oligomer represented by Formula (1) can cover surfaces of untreated metal oxide particles with a thin, uniform coat film, reducing injection of unnecessary holes and leakage of carriers generated by thermal excitation, without decreasing the electron transportability.

In order not to reduce the electron transportability of the metal oxide particles, the amount of the alkoxysilane oligomer represented by Formula (1) attached to the untreated metal oxide particles is preferably 20% by weight or less and more preferably 19% by weight or less based on the amount of the untreated metal oxide particles. In order to reduce dots and fogging, the amount of the alkoxysilane oligomer represented by Formula (1) attached to the untreated metal oxide particles is preferably 2% by weight or more and more preferably 4% by weight based on the amount of the untreated metal oxide particles.

The amount of the alkoxysilane oligomer represented by Formula (1) attached to metal oxide particles contained in the intermediate layer can be determined, for example, in accordance with the following procedure.

1) a sample containing a binder resin and surface-treated metal oxide particles is prepared. Then, the binder resin is removed from the sample, for example, by burning.

2) the surface-treated metal oxide particles remaining in 1) described above is disintegrated with a hydrofluoric acid aqueous solution using a closed type microwave digestion system or the like to form a solution.

3) the amounts of Si and of Ti in the obtained aqueous solution are measured by ICP-AES. Then, from the obtained ratio Si/Ti, the amount of the attached alkoxysilane oligomer represented by Formula (1) is calculated.

The surface treatment with the alkoxysilane oligomer represented by Formula (1) can be performed by, for example, dispersing the alkoxysilane oligomer represented by Formula (1) and metal oxide particles are in an organic solvent (for example, ethyl alcohol); adding water for effecting hydrolysis and acid catalyst (inorganic acid such as HCl, $H_2SO_4$ and $HNO_3$, organic acid solution of acetic acid, oxalic acid, etc.) followed dispersing treatment to prepare a dispersion; and removing the solvent from the obtained dispersion.

The amount of the alkoxysilane oligomer represented by Formula (1) to be used for surface treatment, mixing/stirring temperature and time, etc., are preferably adjusted in order to provide a good compatibility between the electron transportability of the metal oxide particles and reduction of dots and fogging.

The amount of the alkoxysilane oligomer represented by Formula (1) to be used for surface treatment is preferably 2% by weight to 20% by weight, and more preferably 4% by weight to 19% by weight based on the amount of the untreated metal oxide particles. If the amount of the alkoxysilane oligomer represented by Formula (1) to be used for surface treatment is less than 2% by weight, fogging may not be sufficiently prevented by the surface-treated metal oxide particles, and the blocking property may be insufficient. If the amount of the alkoxysilane oligomer represented by Formula (1) to be used for surface treatment is more than 20% by weight, the electron transportability of the surface-treated metal oxide particles may be reduced, alkoxysilane oligomers react with each other to produce agglomerates, which facilitates increased potential and generation of dots.

The temperature of the dispersion in the dispersion treatment is preferably 5° C. to 70° C., and more preferably about 20° C. to about 50° C. The dispersion treatment time is preferably 0.5 hours to 3 hours in order to sufficiently perform the surface treatment of the metal oxide particles charged into a dispersion treatment unit, and for other purposes. The dispersion method is not particularly limited; however, a wet-process bead milling is preferred in order to suppress agglomeration of the metal oxide particles, and for other purposes.

When necessary, the metal oxide particles may be further surface-treated with other surface treating agents than the alkoxysilane oligomer represented by Formula (1). Namely, the surfaces of the metal oxide particles may be coated with a plurality of layers, and at least one of the layers—preferably a layer in contact with the metal oxide particles—may comprise the alkoxysilane oligomer.

The other treating agents are preferably reactive organic silicon compounds. Examples of the reactive organic silicon compounds include alkoxysilane, reactive silicone oil, or silane coupling agents. Examples of the alkoxysilane include methyltrimethoxysilane, n-butyltrimethoxysilane, n-hexyltrimethoxysilane, and dimethyldimethoxysilane.

Examples of the reactive silicone oil include methylhydrogen polysiloxane, carboxyl-modified silicone oil, monoamine-modified silicone oil, and epoxy-modified silicone oil. Examples of the silane coupling agents include epoxysilane such as 3-glycidoxypropyl methyldimethoxysilane; methacrylsilane such as 3-methacryloxypropyl methyldimethoxysilane; and aminosilane such as 3-aminopropyl trimethoxysilane.

In order to improve the dispersibility of the metal oxide particles, the metal oxide particles are preferably further surface-treated with a reactive organic silicon compound after being surface-treated with the alkoxysilane oligomer. Since such surface-treated metal oxide particles have reactive organic silicon compound layers at their uppermost surface, the dispersibility of the surface-treated metal oxide particles is effectively improved.

The surface treatment of the (surface-treated) metal oxide particles with other surface treating agents can be performed by any of the methods known in the art. The surface treatment with a reactive organic silicon compound can be performed, for example, by 1) adding (surface-treated) metal oxide particles into a solution prepared by dispersing the reactive organic silicon compound in water or an organic solvent, followed by mixing/stirring, and 2) filtrating, drying the obtained solution.

Examples of the binder resin contained in the intermediate layer include polyamide resins, vinyl chloride resins, and vinyl acetate resins. Among these, preferable are alcohol-soluble polyamide resins from the viewpoint of suppressing dissolution of the intermediate layer when the photosensitive layer is applied.

The volume ratio of the metal oxide particles (P) surface-treated with the alkoxysilane oligomer represented by Formula (1) to the binder resin (B) (surface-treated metal oxide particles (P)/binder resin (B)) is preferably 0.4 to 1.3, and more preferably 0.6 to 1.2. When the volume ratio is less than 0.4, the electron transportability of the intermediate layer is excessively low; therefore, unevenness in image density is easily produced. On the other hand, when the volume ratio is more than 1.3, the electron transportability of the intermediate layer is excessively high; therefore, the blocking property is likely to worsen, causing image defects such as fogging.

The volume ratio of the metal oxide particles (P) surface-treated with the alkoxysilane oligomer represented by Formula (1) to the binder resin (B) can be measured using a TGA (Thermogravimetric Analyzer) according to the following method.

i) The specific gravity of the surface-treated metal oxide particles is measured using a true specific gravity measuring apparatus (micropycnometer) made by Estee Inc. The specific gravity of the binder resin is determined as follows: the weight of the binder resin in a molded piece is measured, the molded piece is put into water whose volume is known, and the excluded volume thereof is measured.

ii) Meanwhile, a mixture of the surface-treated metal oxide particles and the binder resin is prepared as a sample to be measured. Next, 5 mg of the sample to be measured is weighed and placed in an aluminum sample pan. Using a simultaneous thermogravimetry and differential thermal analyzer TG/DTA6200 (made by Seiko Instruments Inc.), the weight loss of the sample is measured under a nitrogen gas atmosphere (the amount of the nitrogen gas to be introduced: 150 to 200 mL/min) at a temperature raising rate of 20° C./min as a thermogravimetric curve. The weight of the binder resin is determined from the first weight loss in the thermogravimetric curve, and the weight of the surface-treated metal oxide particles is determined from the remaining weight at that point of time.

iii) Then, from the specific gravity obtained in i) and the weight obtained in ii) of the surface-treated metal oxide particles and those of the binder resin, the volume of the surface-treated metal oxide particles and that of the binder resin are calculated. Thus, the volume ratio (P/B) is calculated.

The film thickness of the intermediate layer is preferably 0.5 to 15 μm, and more preferably 1 to 7 μm. If the film thickness of the intermediate layer is excessively small, the entire surface of the conductive support cannot be covered, and injection of holes from the conductive support may not be sufficiently blocked. On the other hand, an excessively large film thickness of the intermediate layer increases electric resistance, and sufficient electron transportability may not be provided.

Photosensitive Layer

The photosensitive layer has a function to generate charges by light exposure and a function to transport the generated charges to the surface of the photoconductor. Such a photosensitive layer may have a single layer structure in which the same single layer performs the charge generating function and the charge transport function, or a laminate structure in which one layer performs the charge generating function and another layer performs the charge transport function. Preferably, in order to lessen increase in the residual potential caused by repeated use of the photoconductor, the photosensitive layer has a laminate structure composed of the charge generation layer and the charge transport layer. The photoconductor for negative charging preferably has a charge generation layer (CGL) provided on the intermediate layer and a charge transport layer (CTL) provided on the charge generation layer.

Charge Generation Layer (CGL)

The charge generation layer has a function to generate charges by light exposure. Such a charge generation layer usually comprises a charge generation material (CGM) and a binder resin in which the charge generation material is dispersed.

The charge generation material can be phthalocyanine pigments, azo pigments, perylene pigments, and azulenium pigments. The charge generation substance may be selected depending on the sensitivity to the wavelength of exposure light. Preferred are phthalocyanine pigments in order to increase the sensitivity to the wavelength of exposure light in a digital image forming apparatus.

For higher sensitivity, preferred phthalocyanine pigments are a Type Y phthalocyanine pigment or a pigment of an adduct of butanediol and titanyl phthalocyanine.

The Type Y phthalocyanine pigment has a maximum diffraction peak at a Bragg angle (2θ±0.2°) of 27.3° in an X-ray diffraction spectrum using Cu—Kα radiation.

Examples of the pigment of an adduct of butanediol and titanyl phthalocyanine include a pigment of an adduct of 2,3-butanediol and titanyl phthalocyanine. The pigment of an adduct of 2,3-butanediol and titanylphthalocyanine is represented by the following formula. "Pc Ring" in the following formula means a phthalocyanine ring.

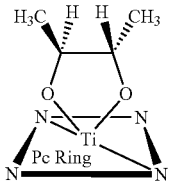

The pigment of an adduct of 2,3-butanediol and titanyl phthalocyanine can have different crystal forms according to the ratio of butanediol to be added. In order to obtain high sensitivity, preferred is a crystal form of an adduct of 2,3-butanediol and titanyl phthalocyanine obtained by reacting 1 mol or less of a butanediol compound with 1 mol of titanyl phthalocyanine. The pigment of the adduct of 2,3-butanediol and titanyl phthalocyanine having such a crystal form has a characteristic peak at a Bragg angle (2θ±0.2°) of at least 8.3° in a powder X ray diffraction spectrum. The pigment of the adduct of 2,3-butanediol and titanyl phthalocyanine has peaks at 24.7°, 25.1°, and 26.5° as well as 8.3°.

The adduct of 2,3-butanediol and titanyl phthalocyanine has an absorption peak of Ti═O at a wavelength in the vicinity of 970 $cm^{-1}$ and an absorption peak of O—Ti—O at a wavelength in the vicinity of 630 $cm^{-1}$ in IR spectrum. In addition, in thermal analysis, a reduction in mass of the adduct of 2,3-butanediol and titanyl phthalocyanine becomes less than 11% at temperatures in the range of 390° C. to 410° C.

The pigment of an adduct of butanediol and titanyl phthalocyanine may be used alone, or may be used as a mixture with a pigment of a non-adduct form of titanyl phthalocyanine. Preferably, the charge generation layer comprises a mixture of a pigment of (a non-adduct form of) titanyl phthalocyanine and a pigment of an adduct of butanediol and titanyl phthalocyanine (preferably, the pigment of the adduct of 2,3-butanediol and titanyl phthalocyanine).

In the photosensitive layer, the ratio, (Abs780/Abs700), of the absorbance at a wavelength of 780 nm (Abs780) to the absorbance at a wavelength of 700 nm (Abs700), is preferably in the range of 0.8 to 1.1, the absorbance Abs780 and the absorbance Abs700 being obtained by conversion from a relative reflectance spectrum of the photosensitive layer containing the mixture of the pigment of titanyl phthalocyanine and the pigment of the adduct of 2,3-butanediol and titanyl phthalocyanine.

Namely, the more the secondary agglomeration of pigment particles are and the more fracture of crystals of pigment particles occur, the absorbance of the photosensitive layer containing the pigment particles decreases at a wavelength in the vicinity of 780 nm, and the ratio of the absorbance (Abs780/Abs700) of the photosensitive layer decreases. Specifically, it is suggested that when the ratio of the absorbance (Abs780/Abs700) of the photosensitive layer is less than 0.8, pigment particles including crystals broken by excessively strong dispersion shearing are contained in the photosensitive layer. In such a photosensitive layer, decomposition of the adduct of 2,3-butanediol and titanyl phthalocyanine is likely to occur in defective portions of crystals of the pigment particles. Therefore, the sensitivity is likely to lower, and the image quality in repeated image formation is likely to degrade. On the other hand, it is suggested that when the ratio of the absorbance (Abs780/Abs700) of the photosensitive layer is more than 1.1, secondarily agglomerated pigment particles and coarse pigment particles caused by dispersion failure are contained in the photosensitive layer. As a result, image defects such as reduced image density may occur.

The ratio of absorbance Abs780 to the absorbance Abs700 in the photosensitive layer can be determined as follows.

1) The reflectance spectrum of the photoconductor is measured with a sample of the photoconductor formed on the aluminum support. The reflectance spectrum of the photoconductor is measured as a relative reflectance when the reflection intensity of the aluminum support measured as a base line is 100%. That is, the relative reflectance is obtained by dividing the reflection intensity of the sample of the photoconductor at each wavelength by the reflection intensity of the aluminum support measured, as a base line, at each wavelength.

2) Next, the obtained reflectance spectrum of the photoconductor is converted to the absorbance spectrum by the following equation:

$$Abs\lambda = -\log(R_\lambda)$$

(wherein $R_\lambda$ represents a relative reflectance obtained by dividing the reflection intensity of the sample of the photoconductor at a wavelength λ by the reflection intensity of the aluminum support at the wavelength λ).

3) Next, in order to remove depressions and projections caused by interference fringes, the absorbance spectrum data obtained by conversion in 2) is approximated to a quadratic polynomial in the wavelength range of 765 nm to 795 nm and in the wavelength range of 685 nm to 715 nm. Then, the ratio of the absorbance at a wavelength of 780 nm, Abs780, to the absorbance at a wavelength of 700 nm, Abs700, (Abs780/Abs700) is calculated.

The reflectance spectrum of the photoconductor can be measured using an optical film thickness measurement apparatus Solid Lambda Thickness (manufactured by Spectra Co-op).

The BET specific surface area of these phthalocyanine pigments is preferably 20 $m^2/g$ or more.

The binder resin is not particularly limited, and can be formal resins, butyral resins, polyvinylbutyral resins, silicone resins, silicone-modified butyral resins, and phenoxy resins, for example. These binder resins can lessen increases in the residual potential accompanied by repeated use of the photoconductor.

The amount of the charge generation material is preferably 20 to 600 weight parts, and more preferably 50 to 500 weight parts based on 100 weight parts of the binder resin. When the amount of the charge generation material is less than 20 weight parts, charges cannot be sufficiently generated by light exposure, leading to a reduced sensitivity of the photosensitive layer. When the amount of the charge generation material is more than 600 parts by weight, the photosensitive layer has an excessively high sensitivity. Accordingly, the residual potential accompanied by repeated use of the photoconductor is likely to increase.

The film thickness of the charge generation layer is not particularly limited. In order to increase the sensitivity, the film thickness is preferably smaller, preferably 0.01 to 5 μm, and more preferably 0.1 to 2 μm.

Charge Transport Layer (CTL)

The charge transport layer has a function to transport the charges generated in the charge generation layer to the surface of the photoconductor. The charge transport layer may be composed of a single layer or two or more layers. The charge transport layer usually comprises a charge transport material (CTM) and a binder resin in which the charge transport material is dispersed.

The charge transport material (CTM) can be triphenylamine derivatives, hydrazone compounds, styryl compounds, benzidine compounds, and butadiene compounds.

The binder resin may be a thermoplastic resin or a thermosetting resin. Examples of the binder resin include polyester resins, polystyrenes, (meth)acrylic resins, vinyl chloride resins, vinyl acetate resins, polyvinyl butyral resins, epoxy resins, polyurethane resins, phenol resins, alkyd resins, polycarbonate resins, silicone resins, and melamine resins. Among these, preferred are polycarbonate resins because they have low water absorbance and can disperse the charge transport material well.

The charge transport layer may further comprise other additives when necessary. Examples of such additives include antioxidants.

The amount of the charge transport material is preferably 10 to 200 weight parts, and more preferably 20 to 100 weight parts based on 100 weight parts of the binder resin. When the amount of the charge transport material is less than 10 weight parts, the charge transportability is insufficient, and the charges generated in the charge generation layer may not be sufficiently transported to the surface of the photoconductor. On the other hand, when the amount of the charge transport material is more than 200 parts by weight, an increase in the residual potential caused by repeated use of the photoconductor is likely to be conspicuous.

The film thickness of the charge transport layer is not particularly limited, and can be approximately 10 to 40 μm.

Over Coat Layer (OCL)

When necessary, the photoconductor of the present invention may include an over coat layer. The over coat layer may comprise a binder resin and inorganic fine particles, and may further comprise an antioxidant and a lubricant when necessary. The over coat layer may be formed by applying a coating solution comprising the binder resin and the inorganic fine particles onto the charge transport layer.

As the inorganic fine particles contained in the over coat layer, fine particles of silica, alumina, strontium titanate, zinc oxide, titanium oxide, tin oxide, antimony oxide, indium oxide, bismuth oxide, indium oxide doped with tin, tin oxide doped with antimony or tantalum, and zirconium oxide can be preferably used. Particularly preferred are hydrophobic silica, hydrophobic alumina, hydrophobic zirconia, and sintered silica fine powder whose surface is hydrophobized.

The number average primary particle size of the inorganic fine particles is preferably 1 to 300 nm, and particularly preferably 5 to 100 nm. The number average primary particle size of the inorganic fine particles is a value obtained by observing 300 particles selected at random as primary particles with a transmission electron microscope at a magnification of ×10,000, and calculating the average of the Feret's diameters from the measured values obtained by image analysis.

The binder resin contained in the over coat layer may be a thermoplastic resin or a thermosetting resin. Examples of the binder resin can include polyvinyl butyral resins, epoxy resins, polyurethane resins, phenol resins, polyester resins, alkyd resins, polycarbonate resins, silicone resins, and melamine resins.

Examples of the lubricant contained in the over coat layer include resin fine powders (such as fine powders of fluorine resins, polyolefin resins, silicone resins, melamine resins, urea resins, acrylic resins, and styrene resins), metal oxide fine powders (such as fine powders of titanium oxide, aluminum oxide, and tin oxide), solid lubricants (such as polytetrafluoroethylene, polychlorotrifluoroethylene, polyvinylidene fluoride, zinc stearate, and aluminum stearate), silicone oils (such as dimethyl silicone oil, methylphenylsilicone oil, methylhydrogenpolysiloxane, cyclic dimethylpolysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxyl-modified silicone oil, and higher fatty acid-modified silicone oil), fluorine resin powders (such as tetrafluoroethylene resin powder, chlorotrifluoroethylene resin powder, hexafluoroethylenepropylene resin powder, vinyl fluoride resin powder, vinylidene fluoride resin powder, dichlolofluoroethylene resin powder, and copolymers thereof), polyolefin resin powders (such as homopolymer resin powders such as polyethylene resin powder, polypropylene resin powder, polybutene resin powder, and polyhexene resin powder; copolymer resin powders of ethylene-propylene copolymers and ethylene-butene copolymers; ternary copolymers of these and hexene; and polyolefin resin powders such as powders of thermally modified product thereof).

The molecular weight of the resin used as the lubricant and the particle size of the powder can be properly selected. The particle size of the resin is particularly preferably 0.1 μm to 10 μm. In order to uniformly disperse these lubricants, a dispersant may be further added to the binder resin.

FIG. 1 illustrates one example of layer configuration of a negative charge type laminated photoconductor. As shown in FIG. 1, in negative charge type laminated photoconductor 10, conductive support 12, intermediate layer 14, charge generation layer 16, and charge transport layer 18 are laminated in this order.

Then, when negative charge type laminated photoconductor 10 is exposed to light, charges generate in the charge generation layer 16. Of the charges generated in charge generation layer 16, electrons move via intermediate layer 14 to conductive support 12. Holes move via charge transport layer 18 to the surface of the photoconductor to cancel the negative charges on the surface of the photoconductor. Thus, an electrostatic latent image is formed on the surface of the photoconductor.

In the present invention, surfaces of metal oxide particles contained in the intermediate layer 14 are surface-treated with an alkoxysilane oligomer represented by Formula (1). It is thus possible to effectively suppress injection of holes from the conductive support 12 and transport of electrons thermally excited in the charge generation layer 16 and reduce image defects such as dots and fogging caused by fluctuations of surface potential of the photoconductor. Further, the metal oxide particles surface-treated with the alkoxysilane oligomer represented by Formula (1) have sufficient electron transportability. Thus, unevenness in image density caused by an increase in potential after light exposure of an image can also be suppressed.

2. Method of Manufacturing Photoconductor

The photoconductor according to the present invention can be manufactured by, for example, the steps of forming an intermediate layer by applying a coating solution for intermediate layer onto a conductive support and drying the coating solution; and forming a photosensitive layer by applying a coating solution for photosensitive layer onto the intermediate layer and drying the coating solution.

The coating solution for intermediate layer contains metal oxide particles surface-treated with the alkoxysilane oligomer represented by Formula (1), a binder resin, and a dispersion solvent for them.

The dispersion solvent contained in the coating solution for an intermediate layer is preferably a $C_{2-4}$ alcohol such as ethanol, n-propyl alcohol or isopropyl alcohol for their high dissolving power for polyamide resins. These dispersion solvents may be used alone, or may be used in combination with a cosolvent. The amount of these dispersion solvents is 30 to 100% by weight, preferably 40 to 100% by weight, and more preferably 50 to 100% by weight based on the total amount of the solvents. Examples of the cosolvent include methanol, benzyl alcohol, toluene, methylene chloride, cyclohexanone, and tetrahydrofuran.

The coating solution for a photosensitive layer comprises the charge generation material or the charge transport material, the binder resin, and a dispersion solvent for dispersing these or a dissolution solvent for dissolving these.

Examples of the dispersion solvent or dissolution solvent contained in the coating solution for a photosensitive layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethyl sulfoxide, and methyl cellosolve. Among these, preferred are methyl ethyl ketone, cyclohexanone, toluene, and tetrahydrofuran.

Preferably, the coating solution for photosensitive layer containing the charge generation material is prepared by dispersing the charge generation material in the solvent under low shearing (low shearing forces). Preferably, dispersion of the charge generation substance into the solvent is performed so that the ratio of the absorbance of the photosensitive layer, Abs780/Abs700, falls within the range of 0.8 to 1.1. The shearing force in the dispersion can be adjusted depending on the dispersion method employed, the dimensions and volume of media to be used for dispersion, the dispersion time, and the like. The dispersing method is not particularly limited. Preferred are those capable of dispersing with low shearing forces, and preferred are ultrasonic dispersion, medium dispersion using a medium having a small specific gravity (glass bead (specific gravity: 2.5), etc.).

As methods for applying a variety of coating solutions (for example, the coating solutions for intermediate layer and for a photosensitive layer) to manufacture the photoconductor according to the present invention, coating methods such as a coating method using a slide hopper type coater, and spray coating can be used, besides dip coating. The coating method using a slide hopper type coater is described in detail, for example, in Japanese Patent Application Laid-Open No. 58-189061.

3. Image Forming Apparatus

Figure 2:
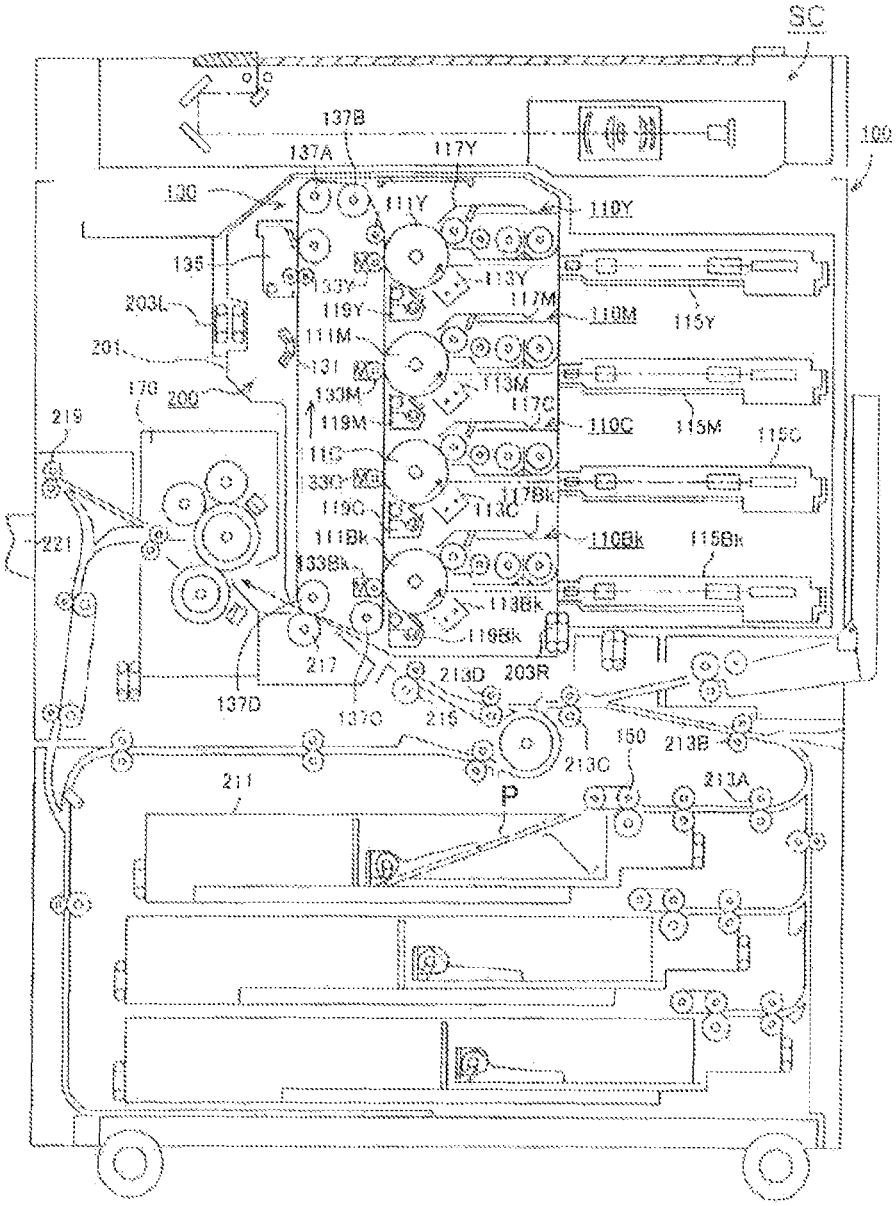
FIG. 2 is a cross-sectional view illustrating an embodiment of an image forming apparatus according to the present invention.

An image forming apparatus according to the present invention includes at least the photoconductor. FIG. 2 is a sectional view showing a configuration of a tandem color image forming apparatus according to the present embodiment. As shown in FIG. 2, image forming apparatus 100 includes four image forming units 110Y, 110M, 110C and 110Bk, intermediate transfer member unit 130, sheet feeding unit 150, and fixing unit 170. Original image reader SC is disposed on the upper portion of main body A of image forming apparatus 100.

Image forming units 110Y, 110M, 110C, and 110Bk are vertically arranged side by side. Image forming units 110Y, 110M, 110C, and 110Bk include photoconductor drums 111Y, 111M, 111C, and 111Bk (electrophotographic photoconductors according to the present invention), charging units 113Y, 113M, 113C, and 113Bk, light exposing units 115Y, 115M, 115C, and 115Bk, developing units 117Y, 117M, 117C, and 117Bk, and cleaning units 119Y, 119M, 119C, and 119Bk, which are sequentially disposed around the circumference of the respective photoconductor drums in the rotating direction thereof. Thereby, toner images of yellow (Y), magenta (M), can (C), and black (Bk) can be formed on photoconductor drums 111Y, 111M, 111C, and 111Bk, respectively. Thus, image forming units 110Y, 110M, 110C, and 110Bk have the same configuration except that the toner images formed on photoconductor drums 111Y, 111M, 111C, and 111Bk have different colors. Accordingly, by way of one example, image forming unit 110Y will be described below.

Charging unit 113Y evenly applies a potential to photoconductor drum 111Y. In the present embodiment, a corona charger is preferably used as charging unit 113Y.

Light exposing unit 115Y has a function to light-expose photoconductor drum 111Y, to which the potential has been evenly applied by charging unit 113Y, based on an image signal (image signal for yellow) to form an electrostatic latent image corresponding to the yellow image. Light exposing unit 115Y can be composed of LEDs having light-emitting elements arranged in an array along the axial direction of photoconductor drum 111Y and an imaging element, or can be a laser optical system.

A light source for exposure is preferably a semiconductor laser or light-emitting diode having an emission wavelength of 350 to 800 nm. Using these light sources for exposure to reduce the light exposure dot diameter in the main scan direction in writing to 10 to 100 μm, then digitally light-exposing the photoconductor, an electrophotographic image having a high resolution of 600 dpi (dpi: the number of dots per 2.54 cm) to 2400 dpi or more can be formed.

The light exposure dot diameter represents a length of an exposure light beam (Ld: measured at a position where the length of the exposure light beam becomes the largest) in a region where the intensity of the light exposure beam is $1/e^2$ or more of the peak intensity, in the main scan direction.

Developing unit 117Y is configured to feed a toner to photoconductor drum 111Y and develop the electrostatic latent image formed on the surface of photoconductor drum 111Y. Cleaning unit 119Y can include a roller or a blade in press contact with the surface of photoconductor drum 111Y.

Endless belt type intermediate transfer member unit 130 is provided such that the unit can contact photoconductor drums 111Y, 111M, 111C, and 111Bk. Intermediate transfer member unit 130 includes endless belt type intermediate transfer member 131; primary transfer rollers 133Y, 133M, 133C, and 133Bk disposed in contact with intermediate transfer member 131; and cleaning unit 135 for cleaning intermediate transfer member 131.

Endless belt type intermediate transfer member 131 is wound around a plurality of rollers 137A, 137B, 137C, and 137D, and rotatably supported by the plurality of rollers 137A, 137B, 137C, and 137D.

In image forming apparatus 100 according to the present embodiment, one or more members selected from the group consisting of charging unit 113Y, exposing unit 115Y, developing unit 117Y, primary transfer roller 133Y, charge eliminating unit (not shown) and cleaning unit 119Y with photoconductor drum 111Y may be integrated to constitute a process cartridge (image forming unit). Alternatively, developing unit 117Y, cleaning unit 119Y and the photoconductor drum 111Y described above may be integrated to constitute a unit detachably mountable on the main body of the apparatus.

Process cartridge 200 in FIG. 2 includes casing 201; photoconductor drum 111Y, charging unit 113Y, developing unit 117Y, and cleaning unit 119Y and intermediate transfer member unit 130 accommodated in casing 201. The main body of the apparatus has support rails 203L and 203R as a unit for guiding process cartridge 200 into the main body of the apparatus. Thereby, process cartridge 200 can be detachably mounted on the main body of the apparatus. Process cartridge 200 can be a single image forming unit detachably mountable on the main body of the apparatus.

Sheet feeding unit 150 is provided to convey toner receiving article P in sheet feeding cassette 211 via a plurality of intermediate rollers 213A, 213B, 213C, and 213D and registration roller 215 to secondary transfer roller 217.

Fixing unit 170 fixes the color image transferred from intermediate transfer member 131 to toner receiving article P by secondary transfer roller 217. Sheet discharging rollers 219 are provided to sandwich toner receiving article P having the fixed color image therebetween and place toner receiving article P onto sheet tray 221 provided on the outside of the image forming apparatus.

Thus-configured image forming apparatus 100 forms an image using image forming units 110Y, 110M, 110C, and 110Bk. Specifically, charging units 113Y, 113M, 113C, and 113Bk negatively charge the surfaces of photoconductor drums 111Y, 111M, 111C, and 111Bk by corona discharging. Next, light exposing units 115Y, 115M, 115C, and 115Bk light-expose the surfaces of photoconductor drums 111Y, 111M, 111C, and 115Bk, respectively, based on the image signal. Thereby, electrostatic latent images corresponding to the respective colors are formed. Next, developing units 117Y, 117M, 117C, and 117Bk feed toner to the surfaces of photoconductor drums 111Y, 111M, 111C, and 111Bk, respectively. Thereby, the respective electrostatic latent images are developed.

Next, primary transfer rollers (first transfer units) 133Y, 133M, 133C, and 133Bk are brought into contact with rotating intermediate transfer member 131. Individual color images formed on respective photoconductor drums 111Y, 111M, 111C, and 111Bk are sequentially transferred onto rotating intermediate transfer member 131 to transfer (primarily transfer) the color images. During the image forming processing, primary transfer roller 133Bk is kept in contact with photoconductor drum 111Bk. On the other hand, other primary transfer rollers 133Y, 133M, and 133C contact corresponding photoconductor drums 111Y, 111M, and 111C only during color image formation.

After primary transfer rollers 133Y, 133M, 133C, and 133Bk are separated from intermediate transfer member 131, toner remaining on surfaces of photoconductors 111Y, 111M, 111C, and 111Bk is removed by cleaning units 119Y, 119M, 119C, and 119Bk. For the next image formation, when necessary, charge on each of the surfaces of photoconductor drums 111Y, 111M, 111C, and 111Bk is eliminated by a charge eliminating unit (not shown). Subsequently, charging units 113Y, 113M, 113C, and 113Bk negatively charge the surfaces of photoconductor drums 111Y, 111M, 111C, and 111Bk, respectively.

Meanwhile, toner receiving article P (a support carrying a final image, for example, plain paper, transparent sheet, etc.) accommodated in paper feeding cassette 211 is fed by sheet feeding unit 150, and conveyed via the plurality of intermediate rollers 213A, 213B, 213C, and 213D and registration roller 215 to secondary transfer roller (secondary transferring unit) 217. Secondary transfer roller 217 is brought into contact with rotating intermediate transfer member 131 to transfer (secondarily transfer) the color image onto toner receiving article P at a time. Secondary transfer roller 217 contacts intermediate transfer member 131 via toner receiving article P only during the time of secondary transfer onto toner receiving article P. Subsequently, toner receiving article P an which the color image has been transferred at a time is separated from intermediate transfer member 131 at a portion thereof having a high curvature.

Toner receiving article P having the transferred color image as above is subject to fixation by fixing unit 170, then advanced while sandwiched between sheet discharging rollers 219, and placed onto sheet tray 221 on the outside of the apparatus. Also, after toner receiving article P on which the color image is transferred at a time is separated from intermediate transfer member 131, residual toner on intermediate transfer member 131 is removed by cleaning unit 135.

In the present embodiment, receiving media such as intermediate transfer member 131 and toner receiving article P, which are configured to receive a toner image formed on photoconductor drums 111Y, 111M, 111C, and 111Bk are collectively called "recording media."

As described above, the intermediate layer in photoconductor drums 111Y, 111M, 111C, and 111Bk included in image forming apparatus 100 according to the present embodiment has sufficient electron transportability. For this reason, increase in the residual potential on the surfaces of photoconductor drums 111Y, 111M, 111C, and 111Bk can be lessened, and unevenness in image density can be reduced. Further, the intermediate layer in photoconductor drums 111Y, 111M, 111C, and 111Bk included in image forming apparatus 100 has a good blocking property. For this reason, particularly even in photoconductor drums 111Y, 111M, 111C, and 111Bk including the highly sensitive charge generation layer, unnecessary injection of holes from the conductive support and unnecessary movement of thermally excited carriers from the charge generation layer can be reduced, and image defects such as dots and fogging can be prevented.

The image forming apparatus according to the present invention is used as electrophotographic apparatuses such as electrophotographic copiers, laser printers, LED printers, and liquid crystal shutter printers. Further, the image forming apparatus according to the present invention can be widely used for display units, recording apparatuses, quick printers, plate making apparatuses, and fax machines using electrophotographic techniques.

EXAMPLES

Hereinafter, the present invention will be described more in detail with reference to Examples. It should not be interpreted that the scope of the present invention is limited by these Examples.

1. Production of Surface-Treated Metal Oxide Particles

Synthesis Example 1

100 parts by weight of titanium oxide particles baying an average primary particle size of 35 nm (produced by TAYCA Corporation, MT-500B) were dispersed in 500 parts by weight of ethanol, 20 parts by weight of SILICATE 40 (produced by Tama Chemicals Co., Ltd., ethoxysilane oligomer, average polymerization degree: 5) as an alkoxysilane oligomer represented by Formula (1) were added thereto, and then 5 parts by weight of acetic acid as a catalyst and 4 parts by weight (corresponding to 1.1 equivalent amount) of water for promoting the hydrolysis 100% were respectively added thereto, followed by being strongly dispersed so as to keep the titanium oxide particles from coalescing. The obtained dispersion was dried, and the obtained solids were disintegrated, thereby obtaining surface-treated metal oxide particles 1.

Synthesis Example 2

100 parts by weight of surface-treated metal oxide particles 1 obtained in Synthesis Example 1 were dispersed in 300 parts by weight of toluene, and then 4 parts by weight of dimethylpolysiloxane-methylhydrogen polysiloxane copolymer, (produced by Shin-Etsu Chemical Co., Ltd., KF9901, hereinbelow, also referred to as "dimethicone/methicone copolymer"), followed by being strongly dispersed so as to keep surface-treated metal oxide particles 1 from coalescing. The obtained dispersion was dried, and the obtained solids were disintegrated, thereby obtaining surface-treated metal oxide particles 2.

Synthesis Example 3

100 parts by weight of titanium oxide particles having an average primary particle size of 35 nm (produced by TAYCA Corporation, MT-500B) were dispersed in 500 parts by weight of ethanol, 16 parts by weight of M SILICATE 51 (produced by Tama Chemicals Co., Ltd., methoxysilane oligomer, average polymerization degree: 4) were added thereto, and then 0.3 parts by weight of 2% hydrochloric acid aqueous solution and 3.4 parts by weight of water were respectively added thereto, followed by being strongly dispersed so as to keep the titanium oxide particles from coalescing. The obtained dispersion liquid was dried, and the obtained solids were disintegrated, thereby obtaining surface-treated metal oxide particles 3A.

The obtained surface-treated metal oxide particles 3A were surface-treated with the dimethicone/methicone copolymer in the same manner as in Synthesis Example 2, thereby obtaining metal oxide particles 3.

Synthesis Example 4

100 parts by weight of titanium oxide particles haying an average primary particle size of 35 nm (produced by TAYCA Corporation, MT-500B) were dispersed in 500 parts by weight of ethanol, 19 parts by weight of ETHYL SILICATE 48 (produced by Colcoat Co., Ltd., ethoxysilane oligomer, average polymerization degree: 10) were added thereto, and then 0.3 parts by weight of 2% hydrochloric acid aqueous solution and 3 parts by weight of water were respectively added thereto, followed by being strongly dispersed so as to keep the titanium oxide particles from coalescing. The obtained dispersion liquid was dried, and the obtained solids were disintegrated, thereby obtaining surface-treated metal oxide particles 4A.

The obtained surface-treated metal oxide particles 4A were surface treated with the dimethicone/methicone copolymer in the same manner as in Synthesis Example 2, thereby obtaining metal oxide particles 4.

Synthesis Example 5

Surface-treated metal oxide particles 5 were obtained in the same manner as in Synthesis Example 2 except that 4 parts by weight of the dimethicone/methicone copolymer were replaced by 6 parts by weight of hexyltrimethoxysilane.

Synthesis Example 6

Surface-treated metal oxide particles 6A were obtained in the same manner as in Synthesis Example 1 except that the titanium oxide particles having an average primary particle size of 35 nm (produced by TAYCA Corporation, MT-500B) were replaced by titanium oxide particles having an average primary particle size of 10 nm (produced by TAYCA Corporation, AMT-100).

Next, surface-treated metal oxide particles 6A were surface-treated with the dimethicone/methicone copolymer in the same manner as in Synthesis Example 2, thereby obtaining surface-treated Metal Oxide Particles 6.

Synthesis Example 7

100 parts by weight of titanium oxide particles having an average primary particle size of 30 nm (produced by TAYCA Corporation, AMT-600) were dispersed in 500 parts by weight of ethanol, 20 parts by weight of ETHYL SILICATE 48 (produced by Colcoat Co., Ltd., ethoxysilane oligomer, average polymerization degree: 10) were added thereto, and then 0.3 parts by weight of 2% hydrochloric acid aqueous solution and 3 parts by weight of water were respectively added thereto, followed by being strongly dispersed so as to keep the titanium oxide particles from coalescing. The obtained dispersion was dried, and the obtained solids were disintegrated, thereby obtaining surface-treated metal oxide particles 7A.

Next, surface-treated metal oxide particles 7A were surface-treated with the dimethicone/methicone copolymer in the same manner as in Synthesis Example 2, thereby obtaining surface-treated metal oxide particles 7.

Synthesis Example 8

To 30 parts by weight of tetramethoxysilane and 40 parts by weight of tetraethoxysilane, 8 parts by weight of ethanol as a solvent and 1 part by weight of 0.01% sulfuric acid aqueous solution were added. To the obtained solution, ion-exchanged water in an amount equivalent to that of alkoxy group in the solution was added dropwise over 3.5 hours and stirred for 30 minutes. By-produced alcohol and the added ethanol were distilled away from the obtained reaction, and the reaction was passed through an ion exchange membrane for removing sulfuric acid. Thereby a methoxy-ethoxy mixed silane oligomer was obtained. An average polymerization degree of the methoxy-ethoxy mixed silane oligomer was measured by ignition loss and found to be 4.5.

Next, surface-treated metal oxide particles 8A were obtained in the same manner as in Synthesis Example 3 except that 20 parts by weight of SILICATE 40 (produced by Tama Chemicals Co., Ltd., ethoxysilane oligomer, average polymerization degree: 5) were replaced by 22 parts by weight of the methoxy-ethoxy mixed silane oligomer (average polymerization degree: 4.5), and the amount of water was changed from 4 parts by weight to 3.2 parts by weight.

Next, surface-treated metal oxide particles 8A were surface-treated with the dimethicone/methicone copolymer in the same manner as in Synthesis Example 2, thereby obtaining surface-treated metal oxide particles 8.

Synthesis Example 9

Surface-treated metal oxide particles 9 were obtained in the same manner as in Synthesis Example 1 except that the titanium oxide particles having an average primary particle size of 35 nm (produced by TAYCA Corporation, MT-500B) were replaced by zinc oxide particles having an average primary particle size of 30 nm (produced by TAYCA Corporation, MZ300).

Synthesis Example 10

Surface-treated metal oxide particles 9 obtained in Synthesis Example 9 were surface-treated with the dimethicone/methicone copolymer in the same manner as in Synthesis Example 2, thereby obtaining surface-treated metal oxide particles 10.

Synthesis Example 11

Surface-treated metal oxide particles 11 were obtained in the same manner as in Synthesis Example 1 except that 20 parts by weight of SILICATE 40 (produced by Tama Chemicals Co., Ltd., ethoxysilane oligomer, average polymerization degree: 5) were replaced by 28 parts by weight of tetraethoxysilane, and the amount of water was changed from 4 parts by weight to 5.3 parts by weight.

Synthesis Example 12

Surface-treated metal oxide particles 11 were surface-treated with the dimethicone/methicone copolymer in the same manner as in Synthesis Example 2, thereby obtaining surface-treated Metal Oxide Particles 12.

Synthesis Example 13

Surface-treated metal oxide particles 13A were obtained in the same manner as in Synthesis Example 7 except that 20 parts by weight of ETHYL SILICATE 48 (produced by Colcoat Co., Ltd., ethoxysilane oligomer, average polymerization degree: 10) were replaced by 28 parts by weight of tetraethoxysilane, and the amount of water was changed from 3 parts by weight to 5.3 parts by weight.

Next, surface-treated metal oxide particles 13A were surface-treated with the dimethicone/methicone copolymer in the same manner as in Synthesis Example 2, thereby obtaining surface-treated metal oxide particles 13.

Synthesis Example 14

70 parts by weight of titanium oxide particles having an average primary particle size of 35 nm (produced by TAYCA Corporation, MT-500B) were dispersed in 1,000 parts by weight of water, stirred and suspended. Caustic soda was added to 5 L of the obtained aqueous suspension of the titanium oxide particles to adjust the pH of the aqueous suspension to 9.0 or higher. Next, an aqueous solution of 200 g/L of silicate soda in an amount of 175 mL (an amount that $SiO_2$ is 10% by weight based on the amount of the titanium oxide particles) was added to the aqueous suspension, heated to 80° C., and then neutralized by adding sulfuric acid dropwise thereto in 3 hours so that the aqueous suspension had a pH of 6.5. The obtained solution was filtrated and then washed. However, it was impossible to obtain a sufficient amount of the surface-treated titanium oxide particles because of high solution stability of the titanium oxide particles.

Synthesis Example 15

Surface-treated Metal oxide particles 15 were obtained in the same manner as in Synthesis Example 9 except that 20 parts by weight of SILICATE 40 (produced by Tama Chemicals Co., Ltd., ethoxysilane oligomer, average polymerization degree: 5) were replaced by 28 parts by weight of tetraethoxysilane, and the amount of water was changed from 4 parts by weight to 5.3 parts by weight.

Synthesis Example 16

Surface-treated metal oxide particles 15 were surface-treated with the dimethicone/methicone copolymer in the same manner as in Synthesis Example 2, thereby obtaining surface-treated metal oxide particles 16.

The components of the surface-treated metal oxide particles 1 to 16 obtained in Synthesis Examples 1 to 16 are shown in Table 1. All of amounts of the surface treatment agents to be used for the surface treatment shown in Table 1 are parts by weight based on 100 parts by weight of metal oxide particles to be surface-treated.

TABLE 1

| | Surface-treated Metal Oxide Particles No. | Surface-Untreated Metal Oxide Particles | | | | Surface Treatment | | | | Additional Surface Treatment | |
|---|---|---|---|---|---|---|---|---|---|---|---|
| | | Type | Product Name | Crystal Form | Particle Size (nm) | Product Name | Type | Average Degree of Polymerization | Amount Used (part by weight) | Type | Amount Used (part by weight) |
| Synthesis Example 1 | 1 | titanium oxide | MT-500B | rutile | 35 | SILICATE 40 | ethoxysilane oligomer | 5 | 20 | — | — |
| Synthesis Example 2 | 2 | | | | | | | | | dimethicone/methicone copolymer | 4 |
| Synthesis Example 3 | 3 | | | | | M SILICATE 51 | methoxysilane oligomer | 4 | 16 | | |
| Synthesis Example 4 | 4 | | | | | ETHYL SILICATE 48 | ethoxysilane oligomer | 10 | 19 | | |
| Synthesis Example 5 | 5 | | | | | SILICATE 40 | ethoxysilane oligomer | 5 | 20 | hexyltrimethoxysilane | 6 |
| Synthesis Example 6 | 6 | | AMT-100 | anatase | 10 | | | | | dimethicone/methicone copolymer | 4 |
| Synthesis Example 7 | 7 | | AMT-600 | | 30 | ETHYL SILICATE 48 | ethoxysilane oligomer | 10 | 20 | | |
| Synthesis Example 8 | 8 | | MT-500B | rutile | 35 | methoxy/ethoxysilane mixed oligomer | | 4.5 | 22 | | |
| Synthesis Example 9 | 9 | zinc oxide | MZ300 | — | 30 | SILICATE 40 | ethoxysilane oligomer | 5 | 20 | — | — |
| Synthesis | 10 | | | | | | | | | dimethicone/ | 4 |

TABLE 1-continued

| | Surface-treated Metal Oxide Particles No. | Surface-Untreated Metal Oxide Particles Type | Product Name | Crystal Form | Particle Size (nm) | Surface Treatment Product Name | Type | Average Degree of Polymerization | Amount Used (part by weight) | Additional Surface Treatment Type | Amount Used (part by weight) |
|---|---|---|---|---|---|---|---|---|---|---|---|
| Example 10 | | | | | | | | | | methicone copolymer | |
| Synthesis Example 11 | 11 | titanium oxide | MT-500B | rutile | 35 | tetraethoxysilane (monomer) | | 1 | 28 | — | — |
| Synthesis Example 12 | 12 | | | | | | | | | dimethicone/methicone copolymer | 4 |
| Synthesis Example 13 | 13 | | AMT-600 | anatase | 30 | | | | | | |
| Synthesis Example 14 | 14 | | MT-500B | rutile | 35 | treated with silicate | | — | 10 | — | — |
| Synthesis Example 15 | 15 | zinc oxide | MZ300 | — | 30 | tetraethoxysilane (monomer) | | 1 | 28 | — | — |
| Synthesis Example 16 | 16 | | | | | | | | | dimethicone/methicone copolymer | 4 |

2. Manufacture of Photoconductor

Example 1

1) Manufacture of Conductive Support

An aluminum alloy cylindrical-shaped base (Al sleeve) having a length of 362 mm, an outer diameter of 59.95 mm, a surface roughness Rz of 0.75 μm was provided.

2) Formation of Intermediate Layer 1 weight part of the polyamide resin (N-1) below as the binder resin was added to 20 weight parts of a mixed solvent of ethanol/n-propyl alcohol/tetrahydrofuran (volume ratio of 45/20/35), and the solution was mixed with stirring at 20° C. To this solution, 4.2 parts by weight of the surface-treated metal oxide particles 1 were added and dispersed by a bead mill. The dispersion by the bead mill was performed under the following conditions: head filling rate: 80%, circumferential speed: 4 m/s, and mill residence time of 3 hours. The obtained solution was filtrated through a 5 μm filter, and thereby a coating solution for intermediate layer was obtained.

Polyamide Resin (N-1)

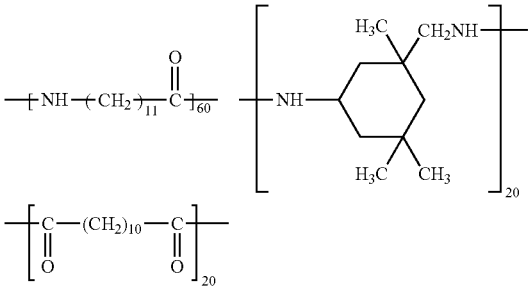

After the Al sleeve was washed, the obtained coating solution for intermediate layer was applied to the Al sleeve by dip coating to form an intermediate layer having a dry film thickness of 2 μm. The volume ratio, P/B, of the surface-treated metal oxide particles (P) to the binder resin (B) was 1.0.

3) Formation of Charge Generation Layer

Synthesis of Charge Generation Material CG-1

29.2 g of 1,3-diiminoisoindoline was dispersed in 200 mL of ortho-dichlorobenzene, 20.4 g of titanium tetra-n-butoxide was added thereto, and then heated, in a nitrogen atmosphere, at 150° C. to 160° C. for 5 hours. After the obtained solution was allowed to stand to deposit crystals, the deposited crystals were filtrated, and subjected to washing with chloroform, washing with 2% hydrochloric acid aqueous solution, washing with water, and washing with methanol, sequentially. After the washing treatments, the obtained crystals were dried to obtain 26.2 g of crude titanyl phthalocyanine.

The obtained crude titanyl phthalocyanine was dissolved with stirring for 1 hour in 250 mL of concentrated sulfuric acid at a temperature of 5° C. or lower, and the solution was poured into 5 L of 20° C. water to deposit crystals. The solution was filtrated, and the obtained crystals were sufficiently washed with water to obtain 225 g of a wet paste product. Next, the wet paste product was frozen in a freezer, unfrozen, filtrated, and dried to obtain 24.8 g (yield: 86%) of amorphous titanyl phthalocyanine.

10.0 g of the obtained amorphous titanyl phthalocyanine and 0.94 g of (2R,3R)-2,3-butanediol (the equivalent ratio of (2R,3R)-2,3-butanediol to the amorphous titanyl phthalocyanine was 0.6) were mixed in 200 mL of ortho-dichlorobenzene, and the obtained mixture was heated with stirring at 60° C. to 70° C. for 6 hours. After the obtained solution was allowed to stand overnight, methanol was further added to deposit crystals. The solution was filtrated, and the obtained crystals were washed with methanol to obtain 10.3 g of charge generation material CG-1 containing an adduct of (2R,3R)-2,3-butanediol and titanyl phthalocyanine.

The X ray diffraction spectrum of charge generation material CG-1 was measured. As a result, it was found that charge generation material CG-1 had peaks at 8.3°, 24.7°, 25.1°, and 26.5°. Also, in mass spectrum, peaks are found at 576 m/z and 648 m/z. Also, in IR spectrum, an absorption peak of Ti═O was found at a wavelength in the vicinity of 970 $cm^{-1}$ and an absorption peak of O—Ti—O was found at a wavelength in the vicinity of 630 $cm^{-1}$. Further, in the thermal analysis (TG), a reduction in mass of about 7% was found at 390° C. to 410° C. From these results, it was deduced that the obtained charge generation material CG-1 was mixed crystals of a 1:1 adduct of titanyl phthalocyanine and (2R,3R)-2,3-butanediol and titanyl phthalocyanine (non-adduct form). The BET specific surface area of the obtained charge generation material CG-1 was measured by a flow-type specific surface area automatic analyzer (Micrometrix FLOWSOAP Model: manufactured by Shimadzu Corporation). As a result, the BET specific surface area was 31.2 $m^2/g$.

Preparation of Coating Solution for Charge Generation Layer and Formation of Charge Generation Layer The components below were mixed, and dispersed by a circulation type ultrasonic homogenizer RUS-600TCVP (manufactured by Nippon Seiki Co., Ltd., 19.5 kHz, 600 W) at a circulation flow rate of 40 L/hr for 0.5 hours to prepare a coating solution for charge generation layer. The coating solution for charge generation layer was applied onto the intermediate layer in the same way as above by dip coating, and dried to form a charge generation layer having a thickness of 0.5 μm.

(Coating Solution for Charge Generation Layer)

Charge generation material: 24 weight parts of CG-1

Binder resin: polyvinyl butyral (produced by Sekisui Chemical Co. Ltd., ESLEC BL-1): 12 parts by weight Dispersion solvent: 3-methyl-2-butanone/cyclohexanone (volume ratio: 4/1): 400 parts by weight 4) Formation of Charge Transport Layer The components below were mixed to prepare a coating solution for a charge transport layer. The coating solution for charge transport layer was applied onto the charge generation layer in the same way as above by dip coating, and dried at 110° C. for 60 minutes to form a charge transport layer having a thickness of 20 μm. Thus, a photoconductor was obtained.

(Coating Solution for Charge Transport Layer)

Charge transport material: the following compound: 200 parts by weight

Binder resin: polycarbonate "UPIRON Z300" (produced by Mitsubishi Gas Chemical Co, Inc.): 300 parts by weight Antioxidant: 2,6-di-t-butyl-4-phenylphenol: 5 parts by weight Dispersion solvent: toluene/tetrahydrofuran=1/9 (v/v): 2,000 parts by weight Charge transport material

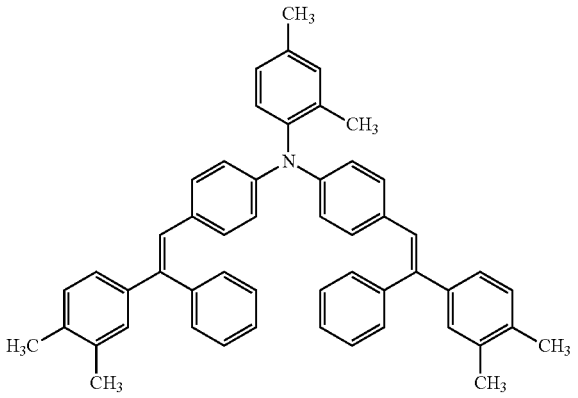

The reflectance spectrum of the obtained photoconductor was measured by an optical film thickness measurement apparatus Solid Lambda Thickness (manufactured by Spectra Co-op). The reflectance spectrum of the photoconductor was measured as a relative reflectance of the reflectance of the photoconductor at each wavelength, on the basis that the reflectance of the Al sleeve measured as a base line at each wavelength is 100% (standard). In order to remove depressions and projections generated by interference fringes in the obtained absorbance spectrum, the absorbance spectrum data was approximated to a quadratic polynomial in a wavelength range of 765 nm to 795 nm and in a wavelength range of 685 nm to 715 nm. Then, the absorbance ratio (Abs780/Abs700) of the absorbance at a wavelength of 780 nm (Abs780) to the absorbance at a wavelength of 700 nm (Abs700) was calculated and found to be 0.99.

Examples 2 to 10

Photoconductors were manufactured in the same manner as in Example 1 except that surface-treated metal oxide particles 1 contained in the coating solution for an intermediate layer were replaced by surface-treated metal oxide particles 2 to 10 shown in Table 1, respectively.

Comparative Examples 1 to 6

Photoconductors were manufactured in the same manner as in Example 1 except that surface-treated metal oxide particles 1 contained in the coating solution for intermediate layer were replaced by surface-treated metal oxide particles 11 to 16 shown in Table 1, respectively.

Using the obtained photoconductor, images were formed. The formed images were evaluated for 1) grayscale, 2) black dots, and 3) fogging, according to the following methods.

Formation of Image

In bizhub PRO C6501 manufactured by Konica Minolta Business Technologies, Inc. (laser exposure, reversal developing, tandem color multifunction machine with an intermediate transfer member), the obtained photoconductor was disposed at a position for Black (Bk). Then, an image was formed under the following conditions.

1) Gradation Characteristic

Under low temperature and low humidity (5° C., 10% RH) conditions, an original image having 60 levels of grayscale from pure white to pure black solid image was formed on a recording paper sheet, POD G GLOSS COAT (100 $g/m^2$) produced by Oji Paper Co., Ltd. The grayscale levels of the obtained original image was visually observed under sufficient daylight. Then, the total number of distinguishable grayscale levels (the total number of levels) was determined, and evaluated according to the following criteria.

◎: The number of distinguishable levels of grayscale is 21 or more (Good)

○: The number of distinguishable levels of grayscale is 12 to 20 (no problem in practical use)

Δ: The number of distinguishable levels of grayscale is 8 to 11 (practical for applications where image quality is of less importance in terms of gradation characteristic)

x: The number of distinguishable levels of grayscale is 7 or less (problematic in practical use)

2) Black Dots

Under the conditions of 20° C. and 50% RH, an image in A4 size, with individual colors of YMCBk at a coverage rate of 2.5% was formed on 200,000 sheets of neutral paper. Thereafter, in the scorotron charger, the grid charge voltage was set to −1,000V, and the developing bias of reversal developing was set to −800V, and a blank image (a white solid image) in A4 size was continuously formed on 10,000 sheets of A4 size paper under high temperature and high humidity conditions (35° C., 85% RH). Then, presence of black dots on the blank image was visually observed at the image formation start time and at the end of the image formation, respectively. "Black dot(s)" means a black dot image that appear in the background or black dots in an image at a coverage rate of 0%.

◎: No black dot is observed in both the start time and the end time of image formation.

○: There is no black dot observed at the start time of image formation, but a small number of black dots (6 dots or less in A4 size paper) are recognized at the end of image formation (a level with no problem in practical use)

x: Black dots are recognized in the initial stage of image formation, and a large number of black dots (6 dots or more in A4 size paper) are recognized at the end of the image formation.

3) Fogging

A recording paper sheet with no image formed thereon (POD G GLOSS COAT produced by Oji Paper Co., Ltd., 100 g/m$^2$, A3 size) was provided. Then, the recording paper sheet was conveyed to the position for Black (Bk), and a blank image (solid image) was formed on the recording paper under the conditions of a grid charge voltage of −800V and a developing bias of −650V. Then, presence of fogging on the obtained recording paper sheet was evaluated. "Fogging" means an image with a slight amount of toner being transferred on the background or a slight amount of toner being transferred in an image at a coverage rate of 0%.

Similarly, a recording paper sheet having a yellow solid image formed thereon (made by Oji Paper Co., Ltd., POD Gloss Coat, 100 g/m$^2$, A3 size) was prepared instead of the recording paper sheet having no image formed thereon. The recording paper sheet was conveyed to the position of black (BK), and a blank image (a yellow solid image) was formed in the same manner as above. Then, presence of fogging on the obtained recording paper sheet was evaluated. Presence of the fogging was evaluated according to the following criterion.

◎: No fogging.

○: Fogging is slightly found when the image is enlarged, but the level of the fogging presents practically no problem.

x: Fogging is found by visually observation, and the level of the fogging presents a problem in practice (no good).

The evaluation results of Examples 1 to 10 and Comparative Examples 1 to 6 are shown in Table 2.

TABLE 2

| | Surface-treated Metal Oxide Particles No. | Surface-Untreated Metal Oxide Particles Type | Crystal Form | Particle Size (nm) | Surface Treatment Type | Average Degree of Polymerization | Amount Used (part by weight) | Additional Surface Treatment | Evaluation Result Gray-Scale | Black Dots | Fogging |
|---|---|---|---|---|---|---|---|---|---|---|---|
| Example 1 | 1 | titanium oxide | rutile | 35 | ethoxysilane oligomer | 5 | 20 | — | ◎ | ○ | ○ |
| Example 2 | 2 | | | | | | | dimethicone/methicone copolymer | ○ | ◎ | ○ |
| Example 3 | 3 | | | | methoxysilane oligomer | 4 | 16 | | ◎ | ◎ | ◎ |
| Example 4 | 4 | | | | ethoxysilane oligomer | 10 | 19 | | ○ | ◎ | ◎ |
| Example 5 | 5 | | | | ethoxysilane oligomer | 5 | 20 | hexyltrimethoxysilane | ○ | ◎ | ◎ |
| Example 6 | 6 | | anatase | 10 | | | | dimethicone/methicone copolymer | ◎ | ○ | ○ |
| Example 7 | 7 | | | 30 | ethoxysilane oligomer | 10 | 20 | | ◎ | ○ | ○ |
| Example 8 | 8 | | rutile | 35 | methoxy/ethoxysilane mixed oligomer | 4.5 | 22 | | ◎ | ○ | ◎ |
| Example 9 | 9 | zinc oxide | — | 30 | ethoxysilane oligomer | 5 | 20 | — | ○ | ○ | ○ |
| Example 10 | 10 | | | | | | | dimethicone/methicone copolymer | ○ | ○ | ○ |
| Comparative Example 1 | 11 | titanium oxide | rutile | 35 | tetraethoxysilane (monomer) | 1 | 28 | — | ◎ | X | X |
| Comparative Example 2 | 12 | | | | | | | dimethicone/methicone copolymer | ◎ | X | ○ |
| Comparative Example 3 | 13 | | anatase | 30 | | | | | ○ | X | X |
| Comparative Example 4 | 14 | | rutile | 35 | treated with silicate | — | 10 | — | impossible to evaluate | | |
| Comparative Example 5 | 15 | zinc oxide | — | 30 | tetraethoxysilane (monomer) | 1 | 28 | — | ○ | X | X |
| Comparative Example 6 | 16 | | | | | | | dimethicone/methicone copolymer | ○ | X | ○ |

As shown in Table 2, it turns out that the photoconductors of Examples 1 to 10 using metal oxide particles having been surface treated with the alkoxysilane oligomer represented by Formula (1) exhibit excellent grayscale (gradation characteristic) and can reduce image defects such as black dots and fogging. On the other hand, it turns out that the photoconductors of Comparative Examples 1 to 6 using metal oxide particles having being surface treated with tetraalkoxysilane (monomer) cannot reduce black dots and fogging, although exhibit excellent gradation characteristic.

INDUSTRIAL APPLICABILITY

The photoconductor according to the present invention includes an intermediate layer excellent in blocking property while maintaining electron transportability. Thus, the photoconductor can reduce image defects such as fogging and dots.

| Reference Signs List | |
|---|---|
| 10 | photoconductor |
| 12 | Conductive support |
| 14 | Intermediate layer |
| 16 | Charge generation layer |
| 18 | Charge transport layer |
| 100 | Image forming apparatus |
| 110Y, 110M, 110C, 110Bk | Image forming unit |
| 111Y, 111M, 111C, 111Bk | Photoconductor drum |
| 113Y, 113M, 113C, 113Bk | Charging unit |
| 115Y, 115M, 115C, 115Bk | Light exposing unit |
| 117Y, 117M, 117C, 117Bk | Developing unit |
| 119Y, 119M, 119C, 119Bk, 135 | Cleaning unit |
| 130 | intermediate transfer member unit |

-continued

| Reference Signs List | |
|---|---|
| 131 | intermediate transfer member (recording medium) |
| 133Y, 133M, 133C, 133Bk | Primary transfer roller (transferring unit) |
| 137A, 137B, 137C, 137D | Roller |
| 150 | Sheet feeding unit |
| 170 | Fixing unit |
| 200 | Process cartridge |
| 201 | Casing |
| 203R, 203L | Support rail |
| 211 | sheet feeding cassette |
| 213A, 213B, 213C, 213D | intermediate roller |
| 215 | Registration roller |
| 217 | Secondary transfer roller (transferring unit) |
| 219 | Sheet discharging roller |
| 221 | Sheet tray |
| P | Toner receiving article (recording medium) |

The invention claimed is:

1. An electrophotographic photoconductor comprising:

a conductive support;

a photosensitive layer disposed on the conductive support; and an intermediate layer disposed between the conductive support and the photosensitive layer, wherein the intermediate layer comprises metal oxide particles and a binder resin, the metal oxide particles being surface-treated with an alkoxysilane oligomer represented by the following Formula (1):

$$Si_nO_{n-1}(OR_1)_m(OR_2)_l \quad \text{Formula (1)}$$

wherein $R_1$ and $R_2$ each individually represents an $C_{1-4}$ alkyl group;

n represents an integer of 2 to 20;

and m and l each individually represents an integer of 0 or more and satisfies an equation m+1=2n+2.

2. The electrophotographic photoconductor according to claim 1, wherein the metal oxide particles are titanium oxide particles surface-treated with the alkoxysilane oligomer represented by Formula (1).

3. The electrophotographic photoconductor according to claim 1, wherein the metal oxide particles are further surface-treated with a reactive silicone oil or alkoxysilane.

4. The electrophotographic photoconductor according to claim 1, wherein a number average primary particle size of the metal oxide particles is 10 nm to 50 nm.

5. The electrophotographic photoconductor according to claim 1, wherein the photosensitive layer contains a mixture of a titanylphthalocyanine pigment with an adduct of 2,3-butanediol and titanyl phthalocyanine, and wherein a ratio of an absorbance at a wavelength of 780 nm, Abs780, to an absorbance at a wavelength of 700 nm, Abs700, Abs780/Abs700 is 0.8 to 1.1, the absorbance Abs780 and the absorbance Abs700 being obtained by conversion from a relative reflectance spectrum of the photosensitive layer.

6. A process cartridge detachably mountable on an image forming apparatus, the process cartridge comprising:

the electrophotographic photoconductor according to claim 1; and at least one unit selected from the group consisting of a charging unit for charging a surface of the electrophotographic photoconductor, a developing unit for feeding a toner to an electrostatic latent image formed on the surface of the electrophotographic photoconductor, a transferring unit for transferring the toner fed to the surface of the electrophotographic photoconductor onto a recording medium, a charge eliminating unit for eliminating charge on the surface of the electrophotographic photoconductor after toner transfer, and a cleaning unit for removing a residual toner from the surface of the electrophotographic photoconductor, wherein the electrophotographic photoconductor and the at least one unit are integrally configured.

7. An image forming apparatus comprising:

an electrophotographic photoconductor according to claim 1, a charging unit for charging a surface of the electrophotographic photoconductor, an light exposing unit for light-exposing the surface of the electrophotographic photoconductor, a developing unit for feeding a toner to an electrostatic latent image formed on the surface of the electrophotographic photoconductor, a transferring unit for transferring the toner fed to the surface of the electrophotographic photoconductor onto a recording medium, a charge eliminating unit for eliminating charge on the surface of the electrophotographic photoconductor after toner transfer, and a cleaning unit for removing a residual toner from the surface of the electrophotographic photoconductor.

* * * * *